US007461804B2

(12) United States Patent
Walters

(10) Patent No.: US 7,461,804 B2
(45) Date of Patent: Dec. 9, 2008

(54) ROTARY KNIFE

(75) Inventor: Keith Walters, Oxon (GB)

(73) Assignee: JO-AT Limited, Berkshire (GB)

( * ) Notice: Subject to any disclaimer, the term of this patent is extended or adjusted under 35 U.S.C. 154(b) by 14 days.

(21) Appl. No.: 11/475,391

(22) Filed: Jun. 27, 2006

(65) Prior Publication Data

US 2007/0001040 A1 Jan. 4, 2007

(30) Foreign Application Priority Data

Jul. 4, 2005 (GB) ..... 0513706.2

(51) Int. Cl.
*B02C 18/36* (2006.01)

(52) U.S. Cl. ..... 241/292.1; 241/82.5

(58) Field of Classification Search ..... 241/292, 241/82.1–82.7

See application file for complete search history.

(56) References Cited

U.S. PATENT DOCUMENTS

| | | | | |
|---|---|---|---|---|
| 1,906,609 A | | 5/1933 | Jahn | |
| 4,093,128 A | * | 6/1978 | Barnes | 241/82.5 |
| 4,202,502 A | * | 5/1980 | Laska | 241/82.5 |
| 6,007,007 A | | 12/1999 | Haack et al. | 241/82.1 |

FOREIGN PATENT DOCUMENTS

| | | |
|---|---|---|
| BE | 369018 A | 4/1930 |
| DE | 873 683 | 2/1950 |
| DE | 3414375 | 10/1985 |
| DE | 4301787 | 1/1993 |
| DE | 102 51 629 | 6/2004 |
| EP | 1295640 | 9/2002 |
| FR | 607099 | 11/1925 |
| RU | 1791020 | 1/1993 |
| RU | 2 184 613 | 10/2002 |

OTHER PUBLICATIONS

Search Report Only.

* cited by examiner

*Primary Examiner*—Mark Rosenbaum
(74) *Attorney, Agent, or Firm*—Christopher L. Holt; Westman, Champlin & Kelly, P.A.

(57) ABSTRACT

There is described a rotary knife for use in a cutting apparatus, comprising a central hub adapted to be mounted with respect to a rotational driveshaft to define an axis of rotation; and a plurality of blades extending outwards from the hub; each blade having respective channels extending across a surface of the blade in a direction substantially parallel to the axis of rotation. There is also described a cutting apparatus having a rotary knife comprising a central hub adapted to be mounted with respect to a rotational driveshaft to define an axis of rotation; and a plurality of blades extending outwards from the hub; each blade having respective channels extending across a surface of the blade in a direction substantially parallel to the axis of rotation.

18 Claims, 4 Drawing Sheets

ROTARY KNIFE

FIELD OF THE INVENTION

The present invention relates to a rotary knife for use in a cutting apparatus such as an industrial food processor, and a cutting apparatus comprising such a knife.

BACKGROUND OF THE INVENTION

Conventionally, industrial food processors, such as meat grinders, are used to process meat into the consistency of sausage meat or burger meat, for example.

As shown in prior art FIGS. 1*a* and 1*b*, an industrial food processor generally comprises a steel rotary knife 10 mounted coaxially between a first perforated disc 12 and a second perforated disc 14 that are also made of steel. The discs 12 and 14 are fixed within a tubular housing (not shown). The knife 10 is rotatable about an axis of the food processor. A diameter of the knife 10 is smaller than a diameter of the discs 12 and 14.

The knife 10 comprises a central aperture 16, a hub 18, and eight arms 20 extending outwards from the hub 18. The central aperture 16 is adapted to receive a driveshaft (not shown). In use, the driveshaft rotates about the axis of rotation in order to rotate the knife 10.

The discs 12 and 14 comprise circular central apertures 22 and 24 respectively, entry surfaces 26 and 30 respectively, and exit surfaces 28 and 32 respectively. In use, the driveshaft may rotate freely relative to the discs 12 and 14 within the circular central apertures 22 and 24. The discs 12 and 14 further comprise a plurality of holes 34 and 36 respectively. The holes 34 and 36 extend through the discs 12 and 14 in a direction parallel to the axis of rotation of the knife 10. The holes 34 in the first disc 12 are larger than the holes 36 in the second disc 14.

The prior art knife 10 will now be described in more detail with reference to FIG. 2.

Each arm 20 of the knife 10 has respective first and second ends 40 and 42 respectively, the first end 40 being free and the second end 42 being connected to the hub 18 by means of a substantially annular portion 44 which surrounds the hub 18. A dimension of the annular portion 44 in the axial direction is less than that of the hub 18 such that the hub 18 protrudes axially from the annular portion 44.

Each arm 20 comprises a respective blade 46 that is substantially V-shaped in profile when viewed from the first end 40 of the arm 20. An axial dimension of each blade 46 is greater than the axial dimension of the annular portion 44 such that the blades 46 also protrude axially from the annular portion 44.

Each blade 46 comprises two planar surfaces 48 and 50 forming the V-shaped profile and two disc-engaging surfaces 52 and 54 that are perpendicular to the axis of rotation. The disc-engaging surfaces 52 and 54 and the planar surfaces 48 and 50 are arranged to have a substantially W-shaped profile when viewed from the first end 40 of the arm 20. Serrations 56 are provided in the blade 46 along an edge 60 joining the planar surface 48 with the disc-engaging surface 52. Similarly, serrations 58 are provided in the blade 46 along an edge 62 joining the planar surface 50 with the disc-engaging surface 54.

Referring back to FIGS. 1*a* and 1*b*, in use, meat, for example, is fed through the food processor in the direction shown by arrow X. The meat is fed through the food processor using, for example, a feed auger (not shown) which also rotates about the axis of rotation. The driveshaft rotates the knife 10 in the direction shown by arrow Y such that the V-shaped blades 46 are on the forward edge of the arms 20 with the V-shaped profile pointing rearwardly with respect to the direction of rotation.

As shown in FIG. 1*a*, the disc-engaging surface 54 rotates flush with the exit surface 28 of the first disc 12, and the disc-engaging surface 52 rotates flush with the entry surface 30 of the second disc 14. Thus, there is friction between the knife 10 and the discs 12 and 14. This reduces the efficiency of the food processor.

As the meat emerges from the holes 34 in the exit surface 28 of the first disc 12, the blades 46 of the knife 10 cut the meat as the knife 10 rotates. More specifically, the meat is cut by a scissor action between edges of the serrations 58 and edges of the holes 34.

The meat continues to be forced through the food processor by the feed auger in direction X. Inevitably, some meat escapes around the first ends 40 of the knife arms 20 due to the reduced diameter of the knife 10 compared to that of the discs 12 and 14. This reduces the efficiency of the food processor.

Eventually, the meat reaches the second disc 14 within range of an arm 20. As the meat enters the holes 36 in the entry surface 30 of the second disc 14, the blades 46 of the knife 10 cut the meat for a second time as the knife 10 rotates. More specifically, the meat is cut by a scissor action between edges of the serrations 56 and edges of the holes 36.

The processed meat is collected when it emerges from the holes 36 in the exit surface 32 of the second disc 14.

The amount of meat which can be processed by an industrial food processor in a given time is of key importance. The present invention seeks to provide an improved rotary knife which enables more efficient operation of a cutting apparatus such as an industrial food processor.

SUMMARY OF THE INVENTION

According to a first aspect of the present invention, there is provided a rotary knife for use in a cutting apparatus, comprising a central hub adapted to be mounted with respect to a rotational driveshaft to define an axis of rotation; and a plurality of blades extending outwards from the hub; each blade having respective channels extending across a surface of the blade in a direction substantially parallel to the axis of rotation.

According to a second aspect of the present invention, there is provided a cutting apparatus having a rotary knife comprising a central hub adapted to be mounted with respect to a rotational driveshaft to define an axis of rotation; and a plurality of blades extending outwards from the hub; each blade having respective channels extending across a surface of the blade in a direction substantially parallel to the axis of rotation.

Advantageously, each blade has a respective first end that is free and a respective second end that merges with the hub. More advantageously, each blade is arcuate between the first end and the second end. Still more advantageously, the arc of each blade is concave. More advantageously again, the arc is arranged such that in use the first end is forward of the second end with respect to a direction of rotation.

Advantageously, each blade has a substantially V-shaped profile when viewed from the respective free end. More advantageously, the V-shaped profile is arranged such that in use the V-shaped profile points rearwardly with respect to a direction of rotation.

Advantageously, a depth of the channels is approximately half of a circumferential dimension of the blades.

Advantageously, a depth of the channels varies along the length of the channels. More advantageously, the depth of the channels decreases towards the centre of the channels.

Advantageously, a width of the channels varies along the length of the channels. More advantageously, the width of the channels decreases towards the centre of the channels.

Advantageously, the channels are arcuate in cross-section. More advantageously, the channels are approximately semi-circular in cross-section.

Advantageously, the rotary knife further comprises a substantially annular portion, the blades merging into the annular portion and the annular portion merging into the hub. More advantageously, a dimension of the annular portion in the direction of the axis of rotation is smaller than a corresponding dimension of the blades.

Advantageously, the channels on each blade are radially offset from the channels on adjacent blades.

Advantageously, the rotary knife comprises an even number of blades. More advantageously, the rotary knife comprises four, six, eight or ten blades.

Advantageously, the cutting apparatus is an industrial food processor. More advantageously, the cutting apparatus is a meat grinder.

Advantageously, the central hub and the blades are integrally formed.

BRIEF DESCRIPTION OF THE DRAWINGS

An embodiment of the present invention will now be described by way of example with reference to the accompanying drawings in which.

DETAILED DESCRIPTION OF A PREFERRED EMBODIMENT

Figure 1A:
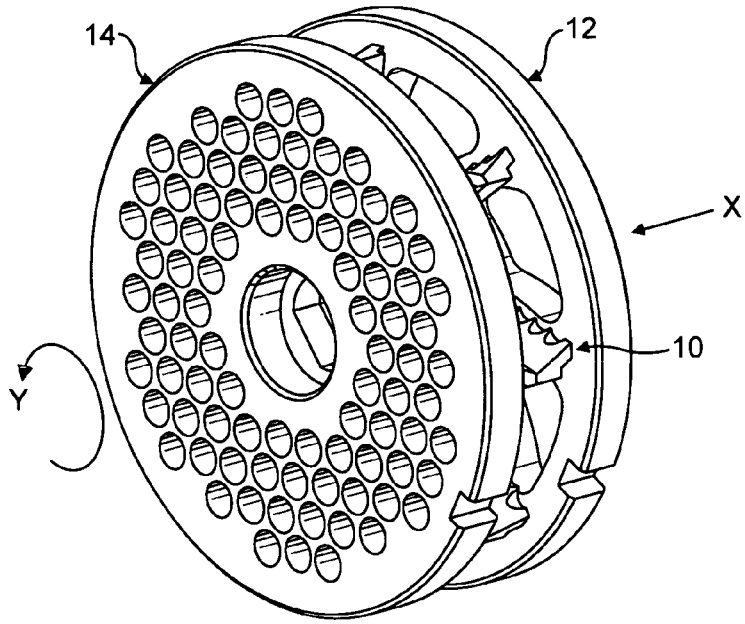
FIG. 1*a* is a perspective view of a prior art rotary knife between two perforated discs.
Figure 1B:
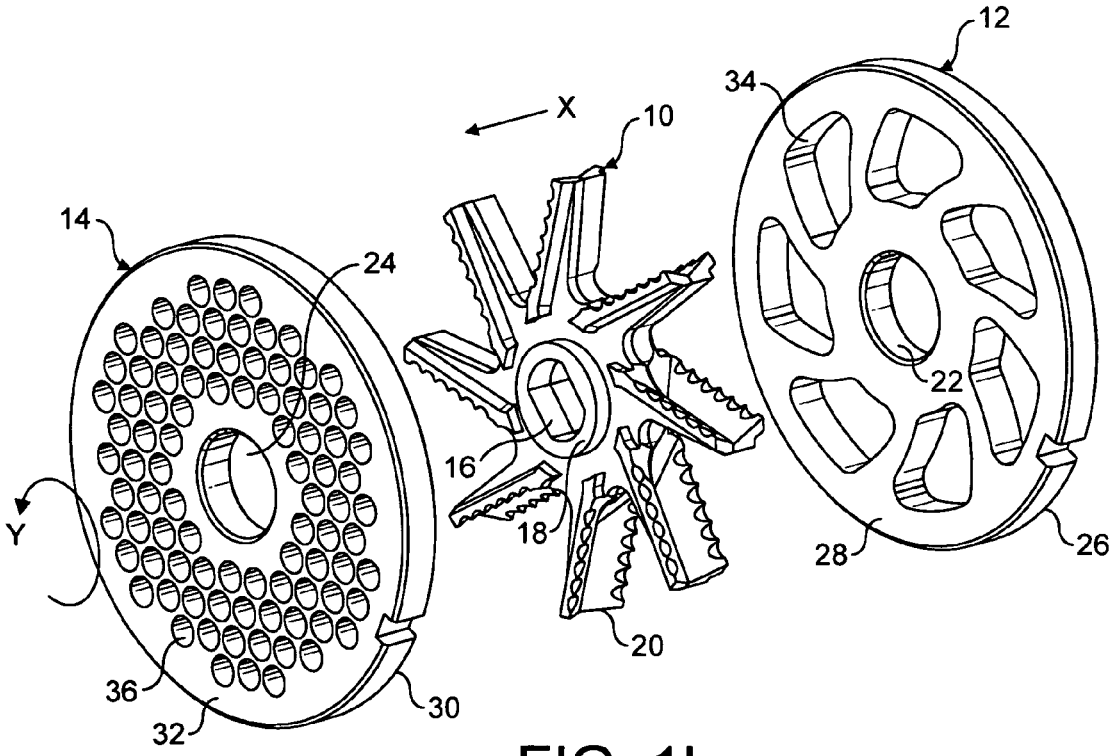
FIG. 1*b* is an exploded view of the arrangement shown in FIG. 1*a;*
Figure 2:
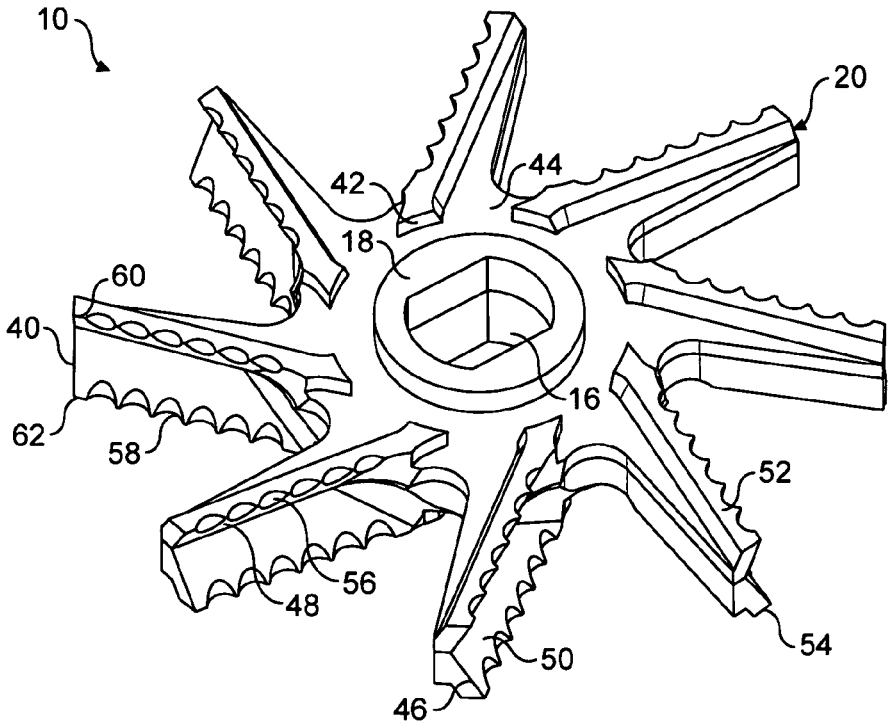
FIG. 2 is a perspective view of the knife shown in FIGS. 1*a* and 1*b;*
Figure 3:
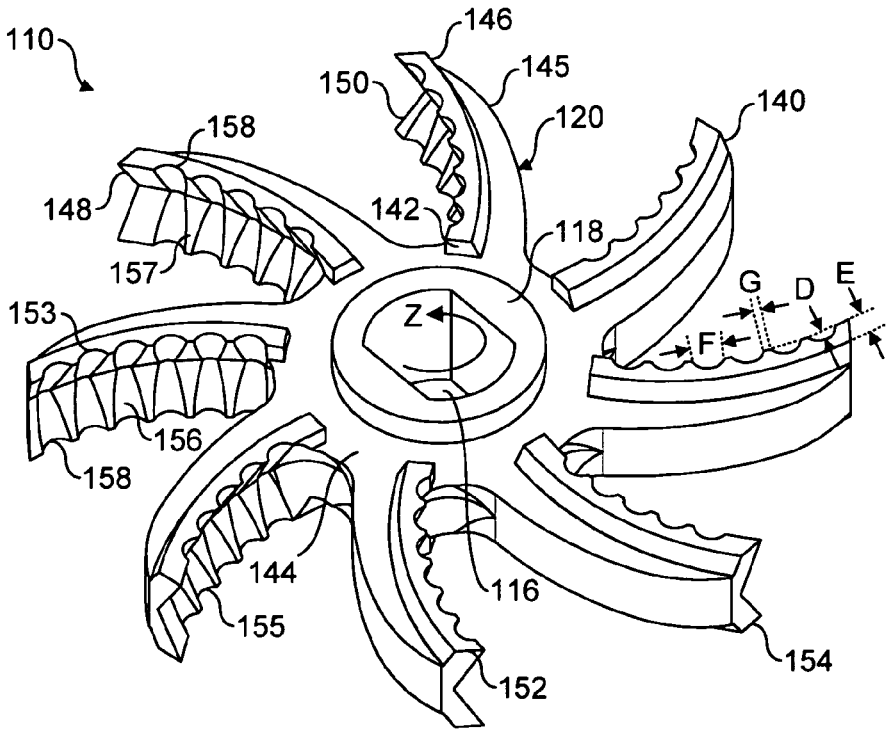
FIG. 3 is a perspective view of a rotary knife according to one embodiment of the present invention.
Figure 4A:
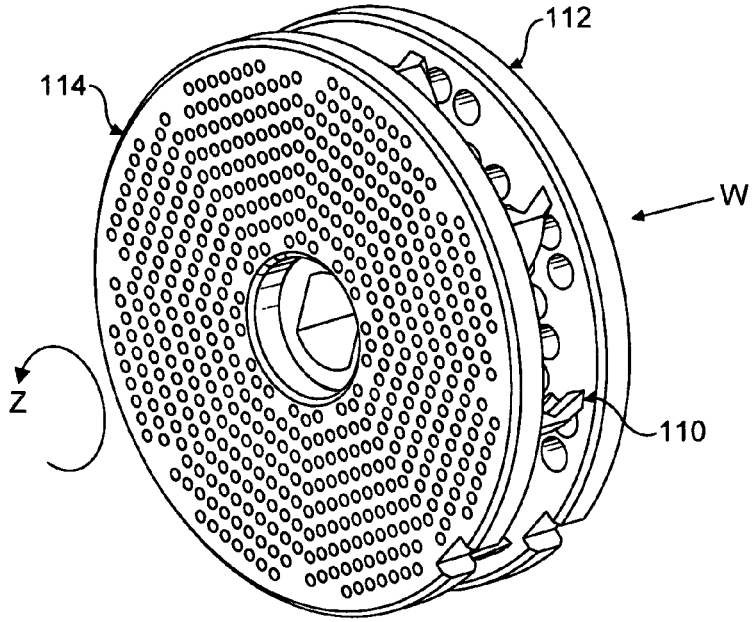
FIG. 4*a* is a perspective view of the knife of FIG. 3 between two perforated discs.
Figure 4B:
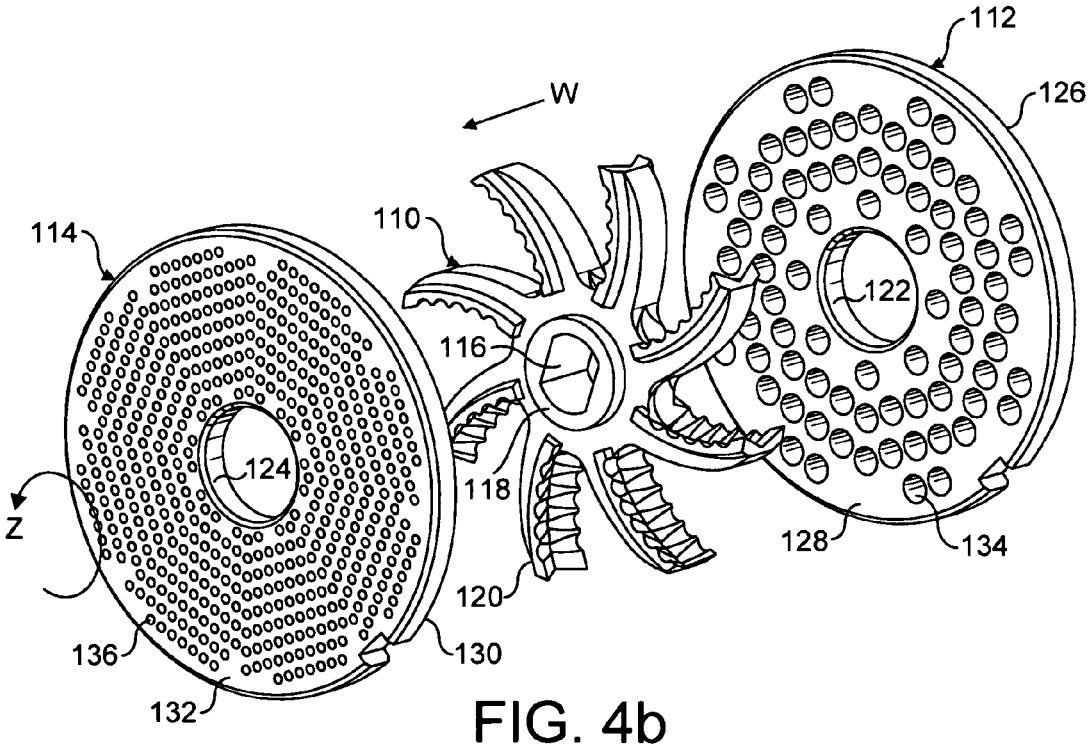
FIG. 4*b* is an exploded view of the arrangement shown in FIG. 4*a*.

FIG. 3 is a perspective view of a rotary knife 110 according to an embodiment of the present invention. The knife 110 is adapted for use in a cutting apparatus such as an industrial food processor. Thus, a cutting apparatus according to one embodiment of the present invention is an industrial food processor comprising the knife 110 mounted coaxially between two perforated discs 112 and 114 as shown in FIGS. 4*a* and 4*b*. The discs 112 and 114 are fixed within a tubular housing (not shown). The knife 110 is rotatable about an axis of the food processor in a direction shown by arrow Z by means of a driveshaft (not shown). Food is fed through the food processor in the direction shown by arrow W. A diameter of the knife 110 is smaller than a diameter of the discs 112 and 114.

In an alternative embodiment, an industrial food processor may contain a further knife 110 and disc such that the configuration of components within the tubular housing comprises two knives 110 interposed between three discs in a disc-knife-disc-knife-disc arrangement.

The discs 112 and 114 are similar to those already described with reference to the prior art so they will only be described briefly here. The discs 112 and 114 comprise circular central apertures 122 and 124 respectively, entry surfaces 126 and 130 respectively, and exit surfaces 128 and 132 respectively. In use, the driveshaft may rotate freely relative to the discs 112 and 114 within the circular central apertures 122 and 124. The discs 112 and 114 further comprise a plurality of circular holes 134 and 136 respectively. The holes 134 and 136 extend through the discs 112 and 114 in a direction parallel to the axis of rotation of the knife 110. The holes 134 in the first disc 112 are larger than the holes 136 in the second disc 114.

Referring back to FIG. 3, the knife 110 comprises a central aperture 116, a hub 118, and eight arms 120 extending outwards from the hub 118. The central aperture 116 is adapted to receive the driveshaft in order to rotate the knife 110 in use. The knife 110 need not have eight arms; in alternative embodiments, knives are provided with four arms, six arms or ten arms. Further alternative arrangements are also envisaged. The knife 110 is integrally formed from a single piece of steel, for example. Alternatively, the arms 120 need not be integrally formed with the hub 118.

Each arm 120 of the knife 110 has respective first and second ends 140 and 142, the first end 140 being free and the second end 142 being connected to the hub 118 by means of a substantially annular portion 144 which surrounds the hub 118. An axial dimension of the annular portion 144 is less than that of the hub 118 such that the hub 118 protrudes axially from the annular portion 144.

Each arm 120 comprises a respective supporting portion 145 and a respective blade 146. The supporting portion 145 merges with and is integrally formed with the annular portion 144. On each arm, the blade 146 is positioned forward of the supporting portion 145 with respect to the rotational direction Z. The blade is substantially V-shaped in profile when viewed from the first end 140 of the arm 120. The V-shaped profile is arranged such that in use the V-shaped profile points rearwardly with respect to the rotational direction Z. An axial dimension of the supporting portion 145 is the same as that of the annular portion 144, whereas an axial dimension of each blade 146 is greater than the axial dimension of the annular portion 144. As a result, the blades 146 protrude axially from the annular portion 144. Thus, in use, only the blades 146, and not the supporting portions 145, make contact with the discs 112 and 114.

Each arm 120 is arcuate between the first and second ends 140 and 142 of the arm 120. Thus, the blades 156 and the supporting portions 145 are also arcuate between the first and second ends 140 and 142 of the respective arms 120. The use of a curved blade is advantageous because the cutting length of the blade is increased (i.e. a curved line between two points is longer than a straight line between the same two points).

Figure 5:
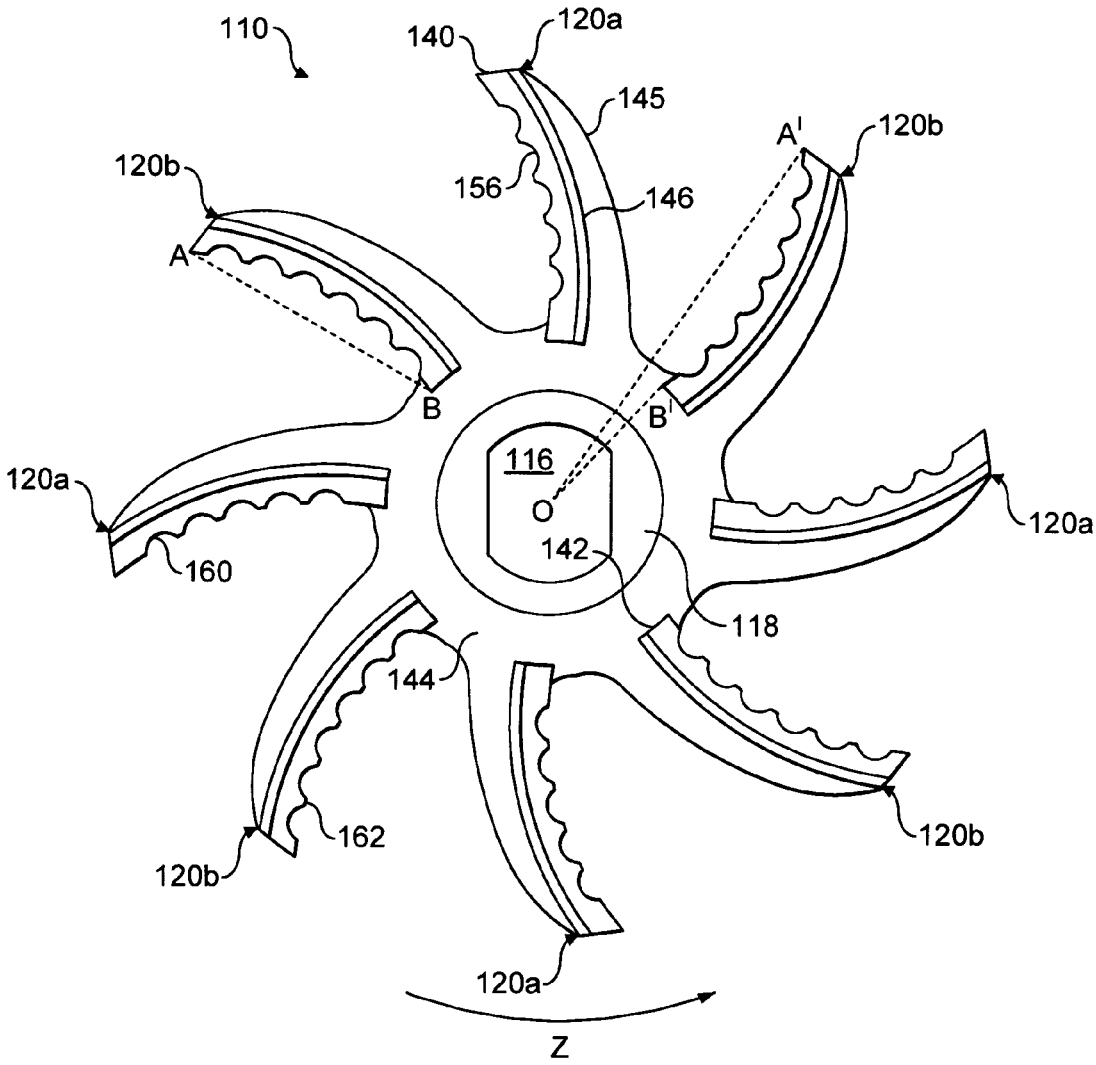
FIG. 5 is an axial view of the knife of FIG. 3.

In this embodiment, the arc of each blade is concave. This is seen more clearly in FIG. 5 which shows an axial view of the knife 110. Line AB is a straight line connecting the first end 140 of the blade 146 to the second end 142 of the same blade 146. Thus, the concave blade 146 bows rearwardly from line AB relative to the rotational direction Z.

Furthermore, the concave arc of each blade 146 is arranged such that the first end 140 is forward of the second end 142 with respect to the rotational direction Z. Again, this is clearly seen in FIG. 5. Line OA' is a straight line connecting the rotational axis (indicated as a point O in this view) to the first end 140 of the blade 146, and line OB' is a straight line connecting the rotational axis to the second end 142 of the same blade 146. Thus, the line OA' is forward of the line OB' relative to the rotational direction Z.

Referring back to FIG. 3, each blade 146 comprises two surfaces 148 and 150 forming the V-shaped profile and two disc-engaging surfaces 152 and 154 that are perpendicular to the axis of rotation. The disc-engaging surfaces 152 and 154 and the V-surfaces 148 and 150 are arranged to have a substantially W-shaped profile when viewed from the first end 140 of the arm 120. In use, the disc-engaging surfaces 152 and 154 are the only parts of each blade 146 in contact with the discs 112 and 114.

Each blade 146 further comprises a plurality of channels 156 extending across the V-surfaces 148 and 150 of the blade 146 from the disc-engaging surface 152 to the disc-engaging surface 154. Thus, the channels 156 run in a substantially axial direction.

Each channel 156 has an arcuate cross-section. Arcuate cross-sections 158 at the disc-engaging surfaces 152 and 154 are approximately semi-circular. Thus, the disc-engaging surfaces 152 and 154 comprise scalloped edges 153 and 155 respectively.

A depth D of the channels 156 at the disc-engaging surfaces 152 and 154 is approximately half of a corresponding circumferential dimension E of the blades 146 at the disc-engaging surfaces 152 and 154. The depth of the channels 156 varies along the length of the channels 156 such that the depth of the channels 156 decreases towards the centre of the channels 156.

Similarly, a width F of the channels 156 varies along the length of the channels 156 such that the width of the channels 156 decreases towards the centre of the channels 156. Thus, ridges 157 between the channels 156 have a width G that increases towards the centre of the ridges 157.

The channels 156 on each blade 146 are radially offset from the channels 156 on adjacent blades 146. Again, this is seen more clearly in FIG. 4. Four arms 120*a* comprise five channels 156, and four arms 120*b* comprise six channels 156. Each arm 120*a* is adjacent to two respective arms 120*b*. Channel centres 160 of arms 120*a* are located at the same radial positions as ridges 162 between the channels 156 of arms 120*b*.

In use, the disc-engaging surface 154 rotates flush with the exit surface 128 of the first disc 112, and the disc-engaging surface 152 rotates flush with the entry surface 130 of the second disc 114. The areas of the disc-engaging surfaces 152 and 154 are reduced compared to prior art knives due to the channels 156. In particular, the depth D of the channels 156 is relatively large so that there are large areas cut out of the disc-engaging surfaces 152 and 154 to form the channels 156. This feature, in combination with the reduced circumferential dimension of the supporting portions 145 compared with that of the blades 146, ensures that there is a smaller contact area between the knife 110 and the discs compared to the prior art, so that friction is reduced and the efficiency of the industrial food processor is increased.

As the meat, for example, emerges from the holes 134 in the exit surface 128 of the first disc 112, the blades 146 of the knife 110 cut the meat as the knife 110 rotates. More specifically, the meat is cut by a scissor action between the scalloped edge 155 of the blade 146 and edges of the holes 134. Due again to the relatively large depth D of the channels 156, the cutting length of the blade 146 (i.e. the total length of scalloped edge 155) is increased compared to prior art knives. The cutting length of the blade 146 is further increased by the arcuate shape of the blade 146 compared to the straight blades 46 of the prior art rotary knife 10. Thus, the efficiency of the food processor is further increased due to more meat being cut by the increased cutting length of the blade 146.

The channels 156 assist in moving the meat efficiently from the exit surface 128 of the first disc 112 to the entry surface 130 of the second disc 114. Meat that has been cut as it emerged from the first disc 112 is channelled along the channels 156 towards the second disc 114. Thus, since the channels 156 are oriented substantially axially (i.e. parallel to the direction W), meat takes an efficient (i.e. short) route between the discs 112 and 114. As a result, meat moves more efficiently through the food processor in direction W so that less power is required to process a given amount of meat in a given time.

Furthermore, since the width F and the depth D of the channels 156 decreases towards the centre of the channels 156, there is a degree of compaction of the meat as it moves towards the centre of the channels 156.

The efficiency of the food processor is further increased by the concave curved blades 146 which help to retain meat, for example, in the area swept by the blades 146 so that less meat escapes around the first ends 140 of the arms 120. This is further helped by the concave arc of each blade 146 being arranged such that the first end 140 is forward of the second end 142 with respect to the rotational direction Z. In addition, since the meat is retained by the curved arms 120, the meat movement has a smaller radial component than in the prior art, so there is less shearing and a cleaner cut is achieved using the present knife 120. The ridges 157 between the channels 156 also prevent meat sliding radially with respect to the blades 146 by acting as barriers between the channels 156.

As the meat enters the holes 136 in the entry surface 130 of the second disc 114, the blades 146 of the knife 110 cut the meat for a second time as the knife 110 rotates. More specifically, the meat is cut by a scissor action between the scalloped edge 153 of the blade 146 and edges of the holes 136. Again, the scalloped edge 153 has a longer cutting edge which contributes to increased food processor efficiency.

Since meat moves more easily through the food processor, there is reduced pressure on the knife 110 and discs 112 and 114, so these components will last longer. Furthermore, the offsetting of the radial positions of the channels 156 between adjacent arms 120 of the knife 110 means that the knife 110 and discs 112 and 114 wear more evenly, which again increases the lifetime of these components.

Although a preferred embodiment of the invention has been described here with reference to processing meat in an industrial, food processor, it is to be understood that this is by way of example only and that various modifications may be contemplated. For example, other foodstuffs such as cheese or vegetables may be processed instead of meat. In a further alternative embodiment, the rotary knife and cutting apparatus may be used in other areas, such as the processing of waste materials, pharmaceuticals, or meat by-products such as offal. Further alternative embodiments are also envisaged.

The invention claimed is:

1. A rotary knife for use in a cutting apparatus, comprising:

a central hub adapted to be mounted with respect to a rotational driveshaft to define an axis of rotation;

a plurality of blades extending outwards from the hub;

each blade having respective channels extending across a surface of the blade in a direction substantially parallel to the axis of rotation;

each channel having a centre that is substantially perpendicular to the axis of rotation and that divides each channel into two portions; and each channel having a width that varies along the length of the channel, wherein the width of the channels decreases towards the centre of the channels.

2. The invention of claim 1 wherein each blade has a respective first end that is free and a respective second end that merges with the hub.

3. The invention of claim 2 wherein each blade is arcuate between the first end and the second end.

4. The invention of claim 1 wherein a depth of the channels is approximately half of a circumferential dimension of the blades.

5. The invention of claim 1 wherein a depth of the channels varies along the length of the channels.

6. The invention of claim 1 wherein the channels are arcuate in cross-section.

7. The invention of claim 6 wherein the channels are approximately semi-circular in cross-section.

8. The invention of claim 1 wherein the rotary knife further comprises a substantially annular portion, the blades merging into the annular portion and the annular portion merging into the hub.

9. The invention of claim 8 wherein a dimension of the annular portion in the direction of the axis of rotation is smaller than a corresponding dimension of the blades.

10. The invention of claim 1 wherein the rotary knife comprises an even number of blades.

11. The invention of claim 10 wherein the rotary knife comprises four, six, eight or ten blades.

12. The invention of claim 1 wherein the central hub and the blades are integrally formed.

13. A rotary knife for use in a cutting apparatus, comprising:

a central hub adapted to be mounted with respect to a rotational driveshaft to define an axis of rotation;

a plurality of blades extending outwards from the hub;

each blade having respective channels extending across a surface of the blade in a direction substantially parallel to the axis of rotation; and each blade having a respective first end that is free and a respective second end that merges with the hub, wherein each blade is arcuate between the first end and the second end, and the arc of each blade is concave.

14. The invention of claim 13 wherein the arc is arranged such that in use the first end is forward of the second end with respect to a direction of rotation.

15. A rotary knife for use in a cutting apparatus, comprising:

a central hub adapted to be mounted with respect to a rotational driveshaft to define an axis of rotation;

a plurality of blades extending outwards from the hub;

each blade having respective channels extending across a surface of the blade in a direction substantially parallel to the axis of rotation;

each blade having a respective first end that is free and a respective second end that merges with the hub; and each blade having a substantially V-shaped profile when viewed from the respective free end.

16. The invention of claim 15 wherein the V-shaped profile is arranged such that in use the V-shaped profile points rearwardly with respect to a direction of rotation.

17. A rotary knife for use in a cutting apparatus, comprising:

a central hub adapted to be mounted with respect to a rotational driveshaft to define an axis of rotation;

a plurality of blades extending outwards from the hub;

each blade having respective channels extending across a surface of the blade in a direction substantially parallel to the axis of rotation;

each channel having a centre that is substantially perpendicular to the axis of rotation and that divides each channel into two portions; and each channel having a depth that varies along the length of the channel, wherein the depth of the channels decreases towards the centre of the channels.

18. A rotary knife for use in a cutting apparatus, comprising:

a central hub adapted to be mounted with respect to a rotational driveshaft to define an axis of rotation;

a plurality of blades extending outwards from the hub;

each blade having respective channels extending across a surface of the blade in a direction substantially parallel to the axis of rotation;

each channel having a width that varies along the length of the channel; and wherein the channels on each blade are radially offset from the channels on adjacent blades.

* * * * *